US007223119B2

(12) United States Patent
Droesbeke

(10) Patent No.: US 7,223,119 B2
(45) Date of Patent: May 29, 2007

(54) CABLE CONNECTOR ASSEMBLY AND SYSTEM

(75) Inventor: Gert Droesbeke, Geel (BE)

(73) Assignee: FCI, Versailles (FR)

( * ) Notice: Subject to any disclaimer, the term of this patent is extended or adjusted under 35 U.S.C. 154(b) by 0 days.

(21) Appl. No.: 10/532,839

(22) PCT Filed: Oct. 20, 2003

(86) PCT No.: PCT/EP03/50734

§ 371 (c)(1),
(2), (4) Date: Nov. 7, 2005

(87) PCT Pub. No.: WO2004/038865

PCT Pub. Date: May 6, 2004

(65) Prior Publication Data

US 2006/0148305 A1 Jul. 6, 2006

(30) Foreign Application Priority Data

Oct. 23, 2002 (NL) ..... 1021724

(51) Int. Cl.
*H01R 13/58* (2006.01)

(52) U.S. Cl. ..... 439/456; 439/466; 439/468; 439/540.1; 439/954

(58) Field of Classification Search ..... 439/456, 439/459, 466, 468, 540.1, 954, 902
See application file for complete search history.

(56) References Cited

U.S. PATENT DOCUMENTS

| | | | | |
|---|---|---|---|---|
| 3,920,306 | A * | 11/1975 | Barnett et al. | 439/459 |
| 4,776,806 | A | 10/1988 | Adams | 439/67 |
| 4,842,547 | A * | 6/1989 | Defibaugh et al. | 439/460 |
| 5,447,454 | A * | 9/1995 | Inaba et al. | 439/709 |
| 5,567,181 | A | 10/1996 | Lentz et al. | 439/694 |
| 5,971,797 | A * | 10/1999 | Straub et al. | 439/468 |
| 6,225,557 | B1 * | 5/2001 | Fonteneau et al. | 174/50 |
| 6,540,547 | B2 * | 4/2003 | Zweigle | 439/468 |
| 6,793,521 | B1 * | 9/2004 | Smedberg | 439/468 |
| 2001/0024904 | A1 * | 9/2001 | Fischer | 439/456 |

FOREIGN PATENT DOCUMENTS

| | | |
|---|---|---|
| DE | 88 09 577 | 9/1988 |
| EP | 0398473 A1 | 11/1990 |
| EP | 0 711 007 A2 | 5/1996 |
| EP | 1 126 556 A2 | 8/2001 |
| JP | 11 040239 A1 | 2/1999 |
| WO | WO 99/27616 | 6/1999 |

* cited by examiner

*Primary Examiner*—Tho D. Ta
(74) *Attorney, Agent, or Firm*—Harrington & Smith, PC

(57) ABSTRACT

The invention relates to a cable connector assembly including cover means and connecting means, wherein the cover means include wall portions and an opening adapted to accommodate the connecting means. At least one of the wall portions is at least partially curved for guiding at least one cable of one or more other cable connector assemblies. Cable ties to attach the cable to the curved wall portion are disclosed are well. The invention facilitates cable management in dense and small cabinets.

12 Claims, 4 Drawing Sheets

CABLE CONNECTOR ASSEMBLY AND SYSTEM

FIELD OF THE INVENTION

The invention relates to a cable connector assembly comprising cover means and connecting means, said cover means comprising wall portions and an opening adapted to accommodate said connecting means.

BACKGROUND OF THE INVENTION

WO 99/27616 discloses a high density electrical connector system, wherein the electrical connectors have a hood with a sloping top. Because of the slope of the hood and the position of the opening in the hood for a cable, a second connector does not interfere with this cable.

SUMMARY OF THE INVENTION

It is an object of the invention to provide a cable connector assembly and a connector system wherein cable management is facilitated. This is important since the cabinets containing the cables are getting smaller and the density of cable connector assemblies on a circuit board increases.

This object is achieved by providing a cable connector assembly characterized in that at least one of said wall portions is at least partially curved for guiding at least one cable of at least one other cable connector. By adapting the cover means such that it allows guiding cables of other cable connector assemblies, these cables can be controlled by the cover means. The curvature of the wall portion can be close to the minimum bend radius at which a signal through the guided cable or the shielding of the cable starts to degrade. For the shielding of the cable, especially the braid is susceptive for bend forces if the bend radius of the cable becomes too small.

In an embodiment of the invention the cover means of the cable connector has means for reducing the movement of a cable over the cover means. Preferably these means include cable tie means for attaching the cable to the partially curved wall portion to secure the guided cable. Alternatively or in addition the curved wall portion may be curved substantially perpendicular to a longitudinal axis of the curved wall portion. This is e.g. advantageous if a single cable is to be guided over the curved wall portion. Moreover other structures or material compositions for the wall portion can be envisaged that are adapted to reduce the movement of the cable.

can be envisaged that are adapted to reduce the movement of the cable.

The invention also relates to a cable connector system comprising at least a first and a second cable connector assembly according to any one of the preceding claims, wherein said first cable connector comprises said at least partially curved wall portion and said second cable connector comprises a wall portion having an opening adapted for directing said cable substantially tangential to said at least partially curved wall portion. By adapting the opening the cable connectors can be positioned in close proximity to each other, thereby providing the possibility to obtain a high density system of cable connectors on e.g. a circuit board with improved cable management features. The system may comprise several cable connector assemblies, wherein the cover means of the assemblies guide at least some of the cable of these cable connector assemblies. These cables can be attached to the cover means by cable tie means. In this way a flexible cable management system is obtained.

The invention also relates to the cover means as such, comprising an at least partially curved wall portion.

BRIEF DESCRIPTION OF THE DRAWINGS

The invention will be further illustrated with reference to the attached drawing, which shows a preferred embodiment according to the invention. It will be understood that the cable connector assembly and system according to the invention are not in any way restricted to this specific and preferred embodiment.

DETAILED DESCRIPTION OF THE INVENTION

Figure 1:
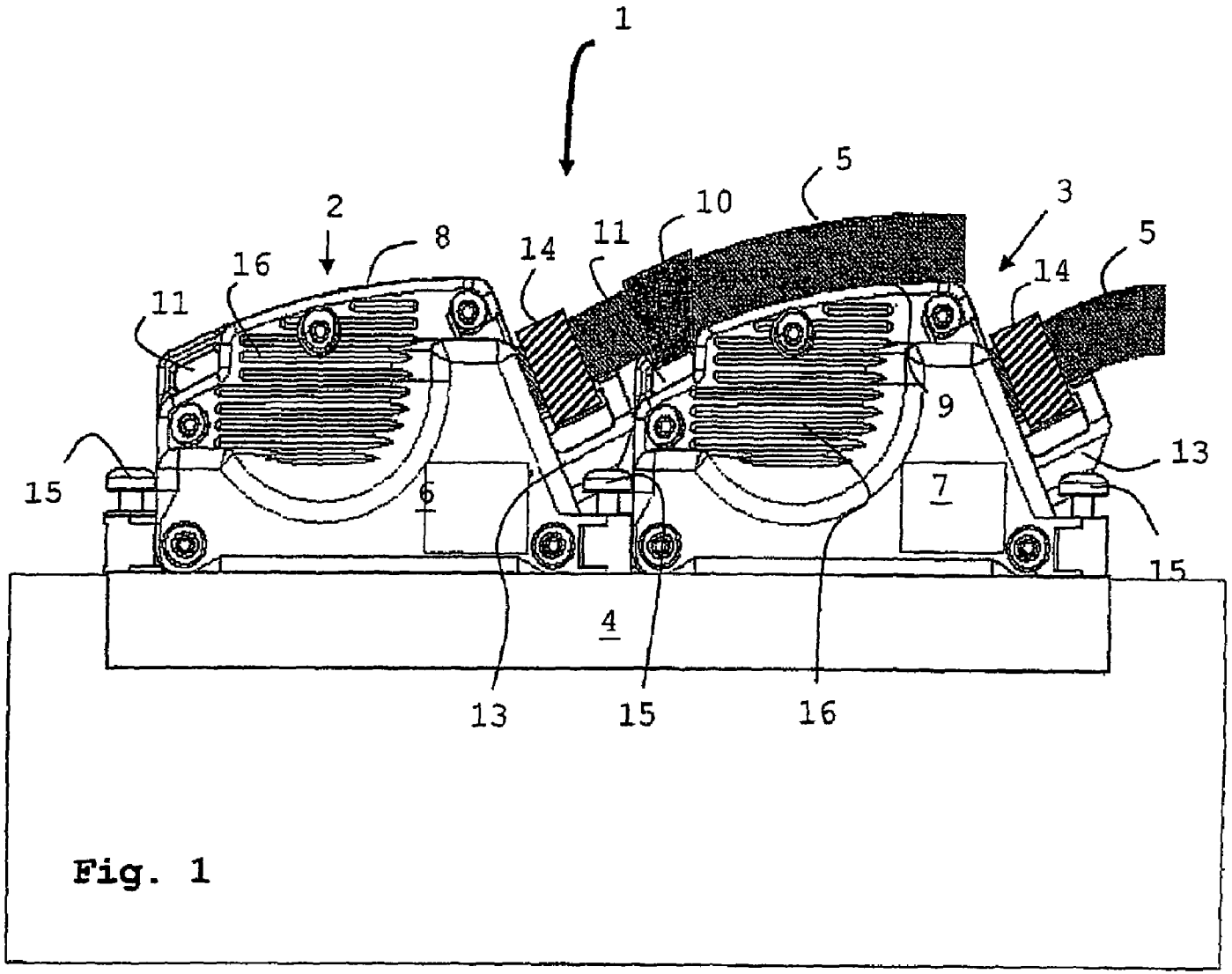
FIG. 1 shows a cable connector system according to an embodiment of the invention.

FIG. 1 shows a cable connector system 1 comprising a first cable connector assembly 2 and a second cable connector assembly 3 on a printed circuit board 4. Each of said assemblies 2, 3 has a cable 5 extending from said assemblies 2, 3. In FIG. 1 only the cover means 6, 7 of respectively the assemblies 2 and 3 are visible. It is noted that cover 6 and 7 may be identical or similar. The cover means 6, 7, hereinafter also referred to as cover, comprises upper wall portions 8, 9 that are curved for guiding the cable 5. The curvature of the upper wall is preferably close to the minimum bend radius of the cable 5. As a general rule the bend radius of the curved wall portion 8, 9 is equal to or higher than five times the outer diameter of the cable. For instance, in a cable connector system 1 with three types of cables 5 with outer diameters of 5, 6.5 and 10 mm, the curvature of the wall portions 8, 9 of the cover means 6, 7 is adapted to the cable 5 with the largest diameter, i.e. the curvature of the wall portions 8, 9 is at least 50 mm.

The cable 5 is reduced in movement and assisted in guidance by the cable tie 10 that attaches cable 5. This cable tie 10 may e.g. be of plastic material and can be adapted to easily fasten and release a cable. Alternatively the cable tie 10 may be a metal or plastic cable clamp. The cable tie 10 may be integrated with the cover means 6, 7. Cable tie 10 may attach several cables 5 from other connector assemblies (not shown) as well. The covers 6, 7 comprise a recess or slot 11 for holding the cable tie 10. It is noted that the recess 11 for the cable tie 10 is not necessarily located near the position on the upper wall where the cable approaches the assembly, but may e.g. be located in the middle of the upper wall 8, 9. Also more than one cable tie 10 can be applied.

The assemblies 2, 3 further comprise cable openings 12 (see FIG. 2) that are e.g. adapted by the alignment part 13 to direct the cable 5 of assembly 2 tangential to the curved wall portion 9 of the assembly 3. To facilitate this alignment an alignment part 13 may have a direction which gives cable 5 a direction which is just below the tangential direction such that contact with the upper wall 9 is ensured. Alignment parts 13 and the tie-wraps 14 may also have a bend relief function in FIG. 1. Alignment part 13 may be an integral part of the cover 6, 7 as well as being a mountable part. The upper wall 9 may comprise a small linear part near the location where the cable 5 meets the cover 7 to define the tangential direction for the cable 5. The cables 5 can be attached to the covers 6, 7 by the tie wrap 14. The assemblies 2, 3 are fastened to the printed circuit board 4 with screws 15. Covers 6 and 7 are provided with indents 16 for fingers to facilitate unmating of the connector assemblies 2, 3 from the headers (not shown) of the printed circuit board 4.

The construction of a cable connector assembly 2, 3 according to two embodiments of the invention will be discussed next in greater detail.

Figure 3:
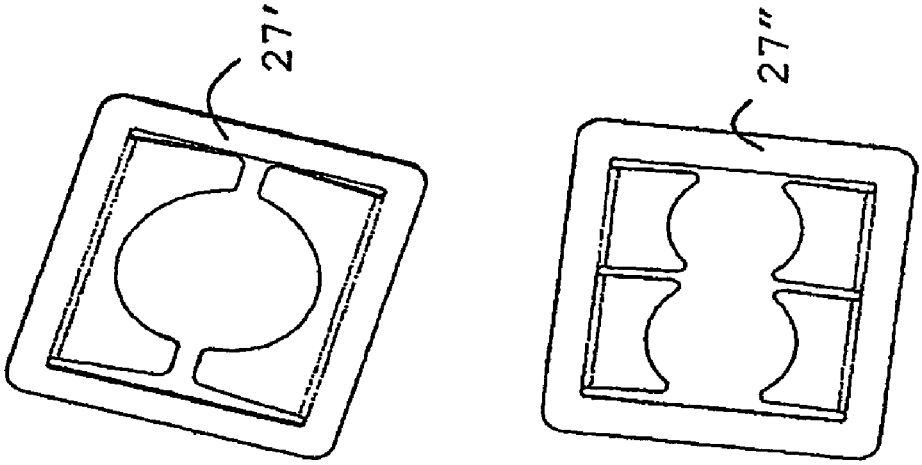
FIG. 3 shows different cable clamp arrangements.
Figure 2:
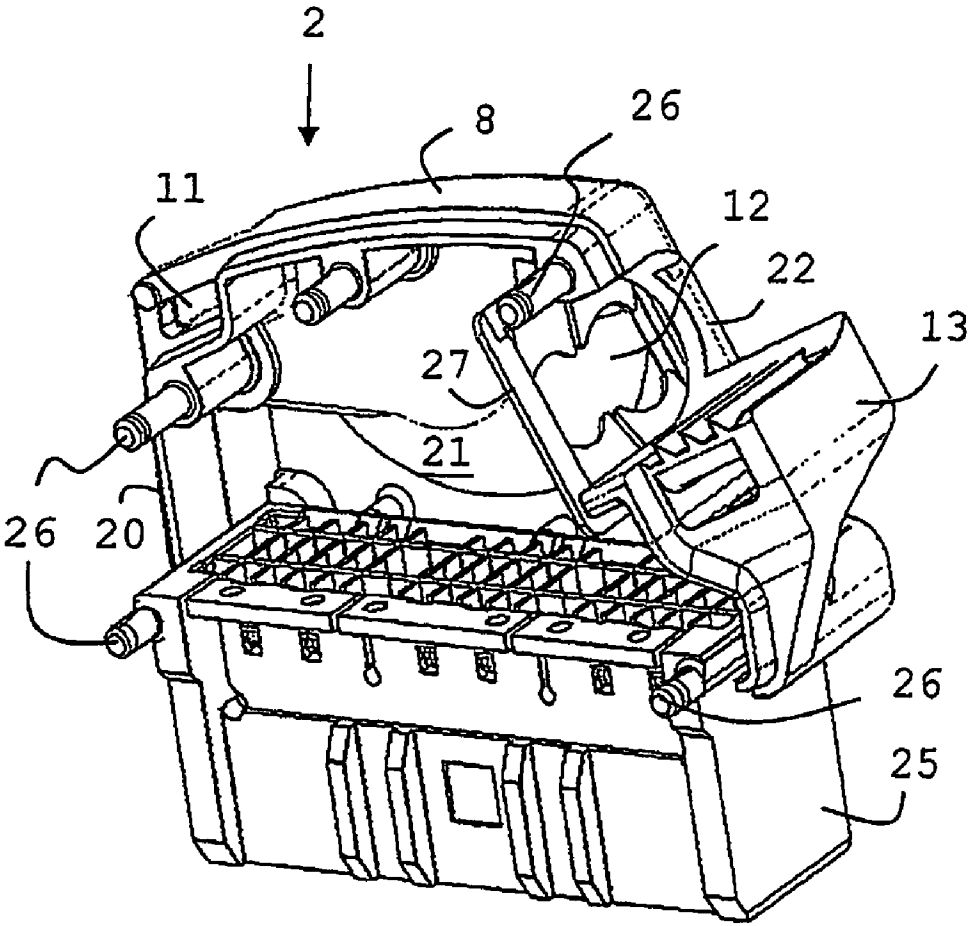
FIG. 2 shows a perspective view of a cable connector assembly according to a first embodiment of the invention.

FIG. 2 shows a perspective view of the connector assembly 2 wherein the front part of the cover 6 is removed. Cover 6 comprises sidewall portions 20, 21 and 22 that together with the front part side wall 23 (see FIG. 4B) of the cover determine an opening 24 opposite to the partially curved upper wall 8, which opening 24 accommodates connecting means or terminal blocks 25 to be mounted on the printed circuit board 4. The front part of the cover 6 can be attached to the assembly 2 by using pins 26. Cable opening 12 may comprise a cable clamp 27 inserted in a slot of the cover 6 for strain relief of the cable 5. A connector assembly 2 may have several cables 5, possibly of different diameters, connected to the terminal blocks 25. Therefore different cable clamps 27', 27" can be used, as shown in FIG. 3. The several cables 5 may all be guided by the upper wall 9 of cable assembly 3 or, alternatively, some of the cables 5 leaving cable assembly 2 are guided by the upper wall 9.

Figures 4A, 4B:
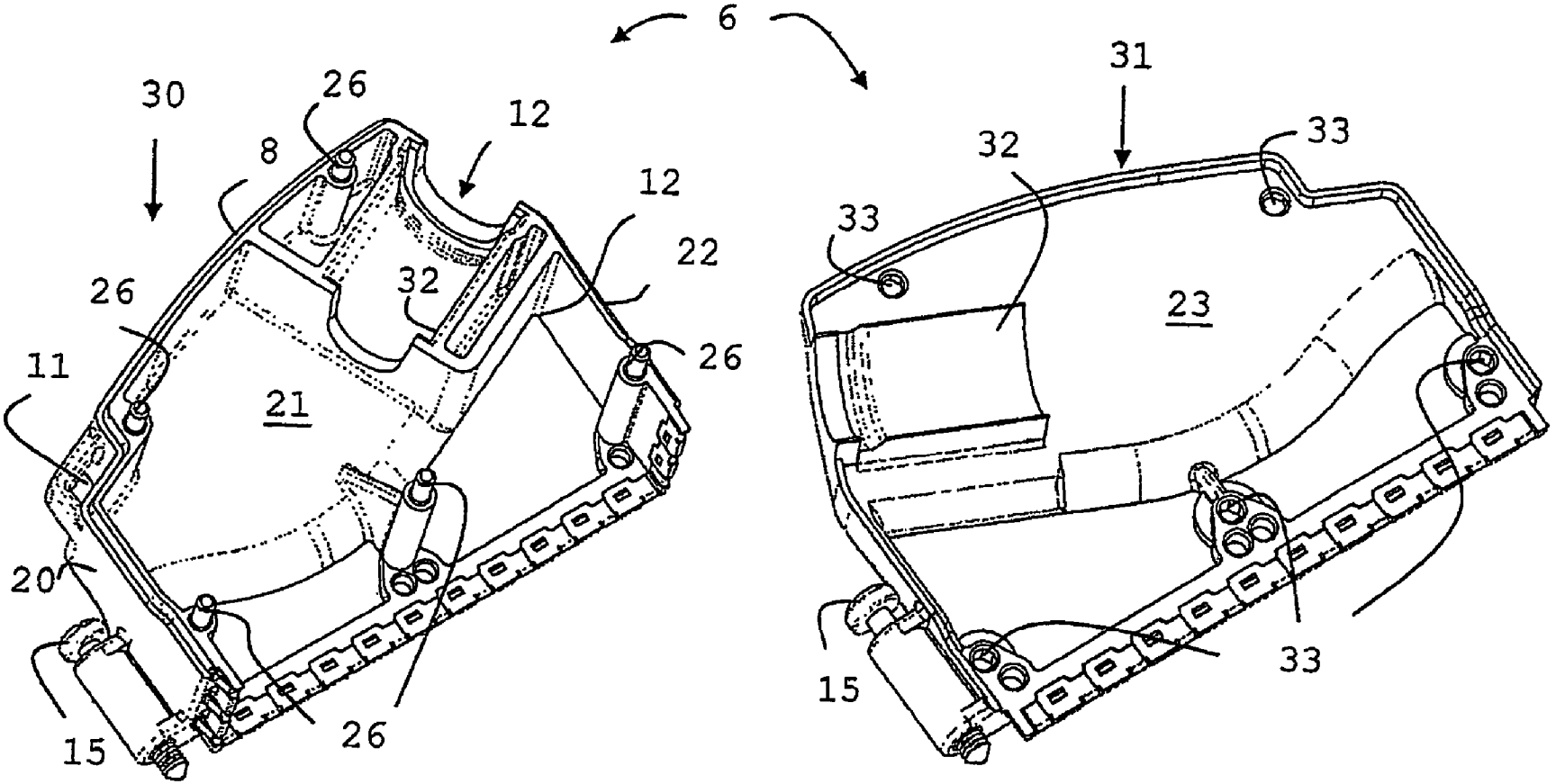
FIGS. 4A and 4B show perspective views of two parts of a cover according to a second embodiment of the invention.

FIGS. 4A and 4B show perspective views of two parts 30 and 31 that are to be attached to each other to form a cover 6. Similar or equivalent parts of the covers with respect to the first embodiment have been assigned identical reference numbers. The alignment part 13 at the cable opening 12 shown in FIG. 2 is omitted in the second embodiment. Instead the sidewalls 21, 23 of the cover 6 comprise a structure 32 forming a tubular cable opening 12 when the sidewalls 21 and 23 are attached to each other by fitting the pins 26 in corresponding holes 33. This tubular cable opening is adapted to perform the same function as the alignment part 13 in FIG. 2.

Figure 5B:
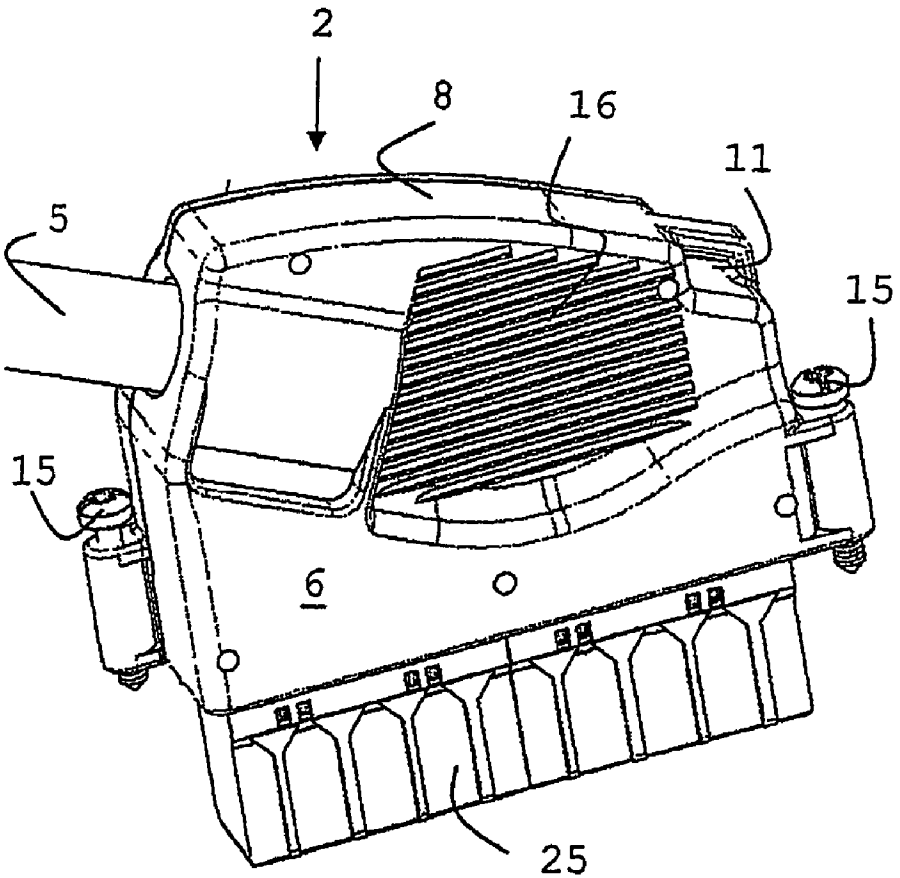
FIGS. 5A and 5B show perspective views of a cable connector assembly according to a second embodiment of the invention.
Figure 5A:
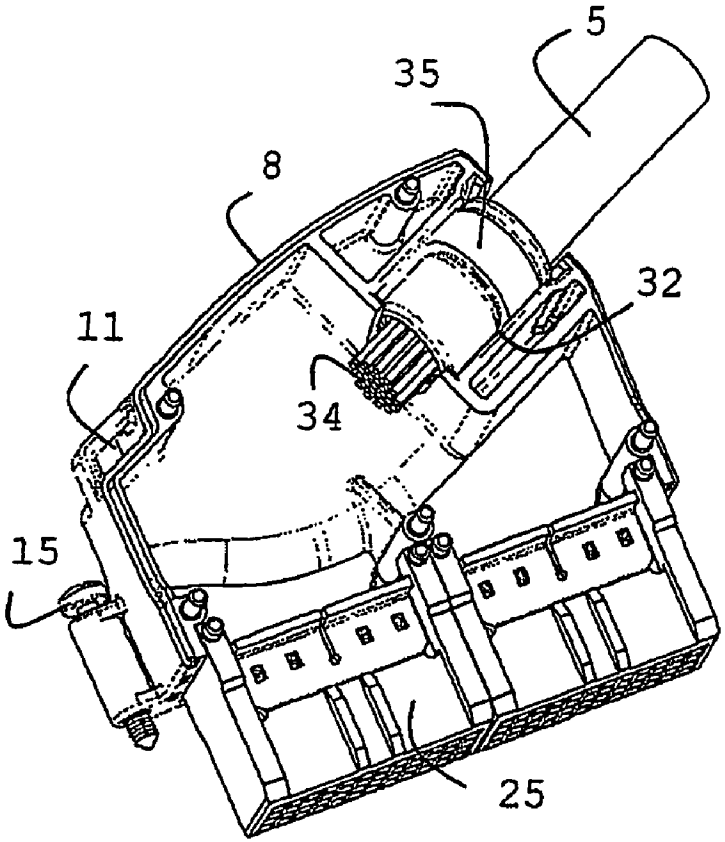

In FIG. 5A the cable assembly 2 is shown comprising a cable 5 in the tubular cable opening 12 formed by the structure 32 in the sidewall 21 of the cover 6. Cable 5 comprises a plurality of wires 34 that are to be connected to the appropriate terminal blocks 25. The cable 5 can be attached to the cover 6 in the tubular cable opening 12 by one or more components 35 for fixation of the cable to the cover 6. Such a component 35 may be a wrap that can be shrunk around the cable 5 and fitted in the tubular opening 12. Component 35 has a similar function as the cable clamps 27, 27', 27" as shown in FIG. 3. In FIG. 5B the connector assembly 2 is shown with the sidewall 23 in place, ready to be mounted to a printed circuit board 4. When mounted cable 5 can be guided by the upper walls of other similar connector assemblies, such as connector assembly 3. In this way management of the cables is improved.

It is noted that the cable or cables 5 of the connector assemblies 2, 3 are not necessarily in contact with the entire upper wall 8, 9. Especially at the end of the curved upper wall, the cable 5 may diverge from the upper wall since e.g. the destination of the cable 5 urges this cable to a particular direction.

Moreover it is noted that alternatively or in addition to the cable tie 10, other means for reducing movement and/or assisting the guidance of the cable 5 can be applied on the upper wall 8, 9. E.g. the upper wall 8, 9 may comprise a groove or further curvature in the longitudinal direction of the upper wall 8, 9. Further, structures or material compositions of or on top of the upper wall 8, 9 that are able to exert a sufficient friction force to the cable 5 when moved can be envisaged as well.

The invention claimed is:

1. Cable connector assembly comprising cover means and connecting means, said cover means comprising wall portions and an opening adapted to accommodate said connecting means, at least one of said wall portions is at least partially curved along a majority of its length and adapted for guiding at least one cable of one or more other cable connector assemblies, wherein the cable connector assembly comprises means for reducing movement and/or assisting guidance of the at least one cable of the one or more other cable connector assemblies.

2. Cable connector assembly according to claim 1, wherein said wall portions comprise said means for reducing movement and/or assisting guidance.

3. Cable connector system comprising at least a first and a second cable connector assembly according to claim 1, wherein said first cable connector assembly comprises said at least partially curved wall portion and said second cable connector assembly comprises a wall portion having a cable opening adapted for directing said cable substantially tangential to said at least partially curved wall portion.

4. Cover means comprising an at least partially curved wall portion according to claim 1.

5. Cable connector assembly according to claim 1 wherein the curved portion of the at least one of said wall portions has a bend radius equal to or higher than five times the outer diameter of the cable.

6. Cable connector assembly comprising cover means and connecting means, said cover means comprising wall portions and an opening adapted to accomodate said connecting means, at least one of said wall portions is at least partially curved and adapted for guiding at least one cable of one or more other cable connector assemblies, wherein the cable connector assembly comprises means for reducing movement and/or assisting guidance of the at least one cable of the one or more other cable connector assemblies, wherein said means for reducing movement and/or assisting guidance comprises cable tie means for attaching said cable to said at least partially curved wall portion.

7. Cable connector assembly according to claim 1, wherein said means for reducing movement and/or assisting guidance comprises a further curvature of said wall portion substantially perpendicular to a longitudinal axis of said at least partially curved wall portion.

8. Cable connector assembly according to claim 1, wherein said wall portions comprise sidewalls determining said opening and an upper wall opposite to said opening which is at least partially curved for guiding the at least one cable of the one or more other cable connector assemblies.

9. Cable connector assembly according to claim 8, wherein said cover means comprises means for holding cable tie means comprising a recess, slot or pin.

10. Cable connector system comprising at least a first and a second cable connector assembly each comprising cover means and connecting means, said cover means comprising wall portions and an opening adapted to accommodate said connecting means, wherein at least one of said wall portions is at least partially curved along a majority of its length for guiding at least one cable of one or more other cable connector assemblies, wherein said first cable connector comprises said at least partially curved wall portion and said second cable connector comprises a wall portion having a cable opening adapted for directing said cable substantially tangential to said at least partially curved wall portion, wherein said system comprises further cable connector assemblies having further cables, said at least partially curved wall portion of said first connector assembly guiding at least some of said further cables.

11. Cable connector system according to claim 10, wherein said first cable assembly comprises cable tie means for attaching said further cables to said at least partially curved wall portion.

12. Cable connector assembly comprising;

an electrical connector; and a cover connected to the electrical connector, wherein the cover is adapted to allow a first cable to extend through the cover and be electrically connected to the electrical connector, wherein the cover comprises wall portions and an opening accommodating the electrical connector, wherein a first one of the wall portions is at least partially curved along a majority of its length and adapted for guiding a second cable of another cable connector assembly on the first wall portion, and wherein the cable connector assembly comprises a cable movement guide proximate the first wall portion for reducing movement and/or assisting guidance of the second cable against the first wall portion.

* * * * *